United States Patent [19]

Eickmann

[11] 4,206,690

[45] Jun. 10, 1980

[54] PIVOT PORTION OF A PISTON SHOE IN RADIAL PISTOL DEVICES

[76] Inventor: Karl Eickmann, 2420 Isshiki, Hayama-machi, Kanagawa-ken, Japan

[21] Appl. No.: 802,231

[22] Filed: Jun. 1, 1977

[51] Int. Cl.[2] ..... F16C 9/04; F16C 11/04; F16J 1/14

[52] U.S. Cl. ..... 92/187; 92/172; 308/3 C; 308/72; 403/39; 403/121

[58] Field of Search ..... 92/58, 187, 172, 158, 92/159, 181; 403/39, 121; 91/488, 491; 308/3 C, 72, 215

[56] References Cited

U.S. PATENT DOCUMENTS

| | | | |
|---|---|---|---|
| 1,435,528 | 11/1922 | Keilholtz | 92/187 |
| 1,772,966 | 8/1930 | Solver | 92/187 |
| 1,899,879 | 2/1933 | Noss | 92/187 X |
| 3,223,046 | 12/1965 | Eickmann | 92/58 |
| 3,255,706 | 6/1966 | Eickmann | 92/58 |
| 3,277,834 | 10/1966 | Eickmann | 92/58 |
| 3,828,653 | 8/1974 | Aldinger et al. | 91/488 |

FOREIGN PATENT DOCUMENTS

| | | | |
|---|---|---|---|
| 2360181 | 7/1974 | Fed. Rep. of Germany | 92/58 |
| 638758 | 6/1950 | United Kingdom | 92/58 |

*Primary Examiner*—Irwin C. Cohen

[57] ABSTRACT

In radial piston fluid handling devices, such as for example pumps or motors, piston shoes are pivotable connected to the respective pistons. The invention improves the swing-member portion of the piston shoe in order to increase the efficiency and pressure bearing capability thereby, that the endface of the pivot portion is formed part-cylindrically by a radius which is a little bit shorter than the radius of the associated piston. The fluid pressure balancing pocket in the pivot member becomes formed accordingly, so that the pressure bearing capacity of the piston-piston-shoe pivot-assembly becomes considerably improved.

10 Claims, 9 Drawing Figures

PIVOT PORTION OF A PISTON SHOE IN RADIAL PISTOL DEVICES

BACKGROUND OF THE INVENTION

It is known for example from my U.S. Pat. No. 3,277,834 that a piston shoe is inserted between the actuator of the piston stroke and the respective piston in radial piston type fluid handling devices. From the said patent it is also known, that the piston shoe is provided with a pivot portion of part-cylindrical configuration in order to swing or pivot in a respective bed of the piston. Fluid pressure balancing pockets were associated to the pivot portion in order to reduce friction between the piston and piston shoe.

Those piston shoes have operated satisfactorily in the past. However, in newer times the rotary velocities of such devices is increased and the pressure in fluid is also increased in radial piston type fluid handling devices. Thereby it appeared, that the total efficiency decreased, when the rotary velocity or pressure was increased. According to this invention it has now been discovered that to a large extent the loss of efficiency came from a too narrow size of the bearing face of the piston shoe's pivot member and by an unsuitable configuration of the ends of the pivot portion and of the location and size of the fluid pressure balancing recess associated thereto. These drawbacks are overcome according to this invention thereby, that the end face of the part-cylindrical pivot portion of the piston shoe becomes formed as a part-cylindrical face with a radius of a slightly shorter size than the radius of the associated piston is. The fluid pressure balancing recess becomes extended in size and its walls are configurated to conform substantially to the invented end face configuration, but leaving enough space to form a suitable sealing face. Further improvements consist in an inclination on the piston-most portion of the end-portions of the pivot member or in the increase of the radius of the bearing face of the pivot portion.

SUMMARY OF THE INVENTION

The main object of the invention is, to overcome the drawbacks of the known pivote portion of the known piston shoe.

In order to achieve this main object of the invention, the first object of the invention is, to increase the bearing portion-size of the pivot member or portion of the piston shoe. The increased size of the bearing face results in the capability of bearing a higher pressure in fluid or in a reduced load per unit of face in case of small pressure in fluid in the device.

The second object of the invention is, to reduce the friction between the pivot portion and the bed of the piston. Thereby the efficiency of the device is increased.

The third object of the invention is, to increase the pressure in fluid in the device and to increase the working speed of the device. Thereby the power of the device for a given size and weight will be increased.

In order to reach and materialize the objects of the invention the following provisions of this invention are done, either single or in combination:

The first provision of the invention is to provide an end-face configuration to the pivot member of the piston shoe to become part-cylindrically shaped with a radius around a middle line of the pivot portion.

The second provision of the invention is, to make the radius of the first provision a little bit smaller, than the radius of the associated piston is.

The third provision of the invention is, to provide an inwards inclination of small, but suitable size on the end face of the first or second provision. This inclination prevents touching or scratching of the end face of the pivote portion on the associated cylinder wall.

The fourth provision is, to extend the fluid pressure balancing recess in the pivot member to such extent, that only a relatively short seal face remains between the end of the pivot member and the fluid pressure balancing recess. Thereby the mechanical friction on each other between sliding faces becomes reduced. This provision further assures, that the remaining seal face (s) remains lubricated enough at all times. The heretofore used too long seal face was not lubricated enough. It has been found in accordance with this invention, that the seal face of the pivot portion of the known art was too long, which resulted teherein, that the endmost portion was not enough lubricated and began to wear off. The wear-off material particles then entered the further portion gradually by time and disturbed the seal face entirely over a respectively long time of use. The shortening of the seal face by this invention prevents this failure of long life of the pivot portion of the former art.

The fifth provision of the invention is, to give the endwalls of the balancing recess of the fourth provision a radius around a middle line of the pivot portion, whereby said radius is respectively suitably shorter than the radius of the end face of the first and second provision.

The sixth provision is, to make the endwalls of the balancing recess inwardly inclined in order to give strength to the sealing portion on the end of the pivot portion and also to increase the length of the seal face at locations little remote from the piston centre, because at these locations the clearance between the seal faces increases, wherefore the length of the seal faces is to be increased at these portions in order to obtain an efficiency maximum as discovered and desired by this invention.

The seventh provision of the invention is, to maintain a vertical bearing face portion or portions on the pivot portion. Because it is an important discovery of this invention, that ball-part-formed pivot members suffer a braking action thereby, that the wide balancing recess is bordered by seal faces, which are stiffly inclined, whereby the pivot portions of the piston shoes of former art became clamped in the respective piston portions, almost like a cone in a coned taper. The balancing recess of the former art in ball-part-formed pivot portions has therefore contrary to the expectations of the former art, not served to prevent friction, but resulted in increased friction or even braking or clamping in the bed of the pistion. These mistakes of the former art are recognized and found by this invention. The provision of a bearing- or seal-face portion vertical to the bottom of the bed in the piston shoe prevents any kind of clamping or braking in a cone-like face.

The eigth provision of the invention is, to provide a control corner in the medial portion of the pivot portion for the purpose of controlling the flow of fluid into balancing recesses in the associated pistons in order to make it possible to locate the balancing recesses in the pistons more properly more outward, than it was possible in the former art. Thereby the friction between the piston and the cylinder wall is reduced especially at large piston strokes and powers.

The nineth provision of the invention is, to extend the balancing recess endwards of the control corner more deeply into the pivot portion in order to obtain a maximum of efficiency of the balancing recess and of the piston-piston-shoe pivot assembly.

The tenth provision of the invention consists in the provision of an associated balancing recess in the bed of the piston, which is associated to the respective pivot portion of the piston shoe.

The eleventh provision of the invention consists in the application of the extension of the pivot bed and face over almost the entire cross-sectionional extension of the piston by increasing the radius around the pivot portion axis to 0.8 to 1.3 of the radius of the piston. Thereby the bearing surface size is increased extensivley. At the same time the medial tangent on the pivot assembly is reduced, so, that the medial bearing force direction becomes more close to the direction of the medial load. This provision reduces friction further, because it extends the size of the bearing face, it extends the size of the balancing recess and it prevents further friction between stiffly inclined portions. And, the twelfth provision of the invention is, to assure a maintainance of contact between the faces of the pivote portion of the piston shoe and the bed of the piston by the application of an assembly or holding means, for example a pin and thereto associated members for the prevention of escape of the piston shoe's pivot portion from the bed of the piston.

BRIEF DESCRIPTION OF THE DRAWINGS

FIG. 1 demonstrates a sectional view through a pivot piston-piston-shoe assembly of the former art, wherein the pivot portion of the piston shoe is partially a ball. Said part-ball is borne in a respectively hollow-ball-part shaped bed in the piston 42. Referential 41 shows the said part-ball formed portion of the pivot portion of the piston shoe. A fluid pressure balancing recess 43 is provided in the piston's bed. Fluid is led into it through passage 44. According to this invention it has now been discovered, that this arrangement of the former art should have the purpose of eliminating or reducing friction between the faces of the members, does actually not reduce the said friction, but on the contrary it increases the friction. That can be understood therefrom, that a face contact consists only outwards of the balancing recess 43. The pivot portion 41 is pressed by fluid pressure towards the piston 42, whereby said force acts substantially in the direction of the axis of the piston. According to this invention, a tangent 51 is drawn onto the medial of the contating bearing faces portions. By simplyfying the part-ball form to a cone between the tangents 51 it will be seen, that, as wider as the balancing recess 43 is, as stiffer becomes the tangent 51 of said cone. In case of a very stiff tangent or medial tangent 51 due to a large balancing recess 43, the cone comes into the self-braking range, so, as for example cones and tapers are used in machine tools for sticking a taper non-moveable into a cone. Thus, if the balancing recess 43 is relatively wide, the piston shoe's pivot portion 41 becomes entirely stuck within the medial cone of the bed of piston 42. Piston and piston shoe are then so strictly blocked within eachother, that the piston shoe cannot pivot any more. If in the device the piston shoe is pivoted by force, the faces between piston and piston shoe weld in eachother and scratch or wear off in short time. When the fluid pressure balancing recess 43 becomes made relatively small in size, the blocking action as described above is prevented, but than the balancing recess does not provide effective reduction of load on the bearing faces. It fails to serve its purpose. The above described matters and effects have obviously not been sufficently discovered until now, because commonly fluid handling devices are only tested as a whole assembly. Thereby the described matters substantially escaped the attention. This discovery of the invention demonstrates most effectively, why the invention prevents such terrible drawbacks of the former art.

Figure 3:
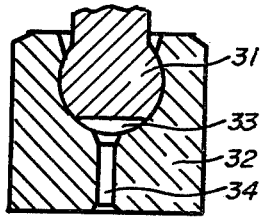
FIG. 3 is a cross-sectional view through FIG. 2 along the line III—III.
Figure 2:
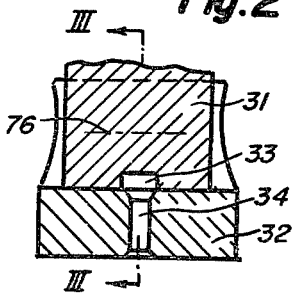
FIG. 2 is a sectional view through another pivote assembly of the former art.
Figure 7:
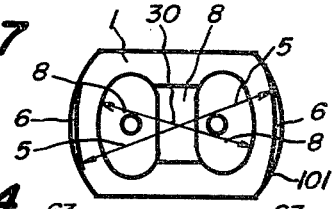
FIG. 7 is a view onto the bottom of the pivot portion of FIG. 4 seen from the line VII—VII.

The assembly of FIGS. 2 and 3 is substantially the assembly of my older U.S. Pat. No. 3,277,834. The pivot portion 31 of the piston shoe is borne in and embraced partially by the bed of the piston 32. Pivot portion 31 is of part-cylindrical shape with an axis normal to the axis of the piston and the ends of said pivot portion are planes, which are normal to the axis of the pivot portion 31. A small rectangular fluid pressure balancing recess 33 is provided in the pivot portion 31 and is filled with fluid under pressure by passage 34 through piston 32. Due to the fact, that the ends were planes, normal to the axis of pivot bar 31, the pivot portion 31 had to be short. Its length had to be substantially shorter than the diameter of the associated piston. Because otherwise, during pivoting motion the end corner of the pivot portion would touch and scratch on the wall of the respective cylinder wherein the piston moves during operation of the machine.

According to this invention it has now been discovered, that the said assembly of FIGS. 2 and 3 of the former art had the following failures:

(a) The portions of the face of the piston bed located beyond the end of the relatively short pivot portion 31 wre not utilized for bearing purposes, whereby the bearing capacity of the assembly remained limited.

(b) The rectangular balancing recess was boardered by much too long sealing surfaces. The result thereof was, that the endportions of the bearing faces were no more lubricated, because under the tight fit under load the fluid could enter only a short distance into the clearance, which became so narrow, that almost no clearance remained. The end portions of the bearing therefore run dry, which resulted in wear off and in moving of worne off material particles into th rest of the bearing, when pressure and/or relative velocities became too high.

The above described failures or drawbacks of the former art have been narrowed or entirely overcome by the improvements which are done by this invention and which are demonstrated in the figures, which are discussed in the following.

Figure 5:
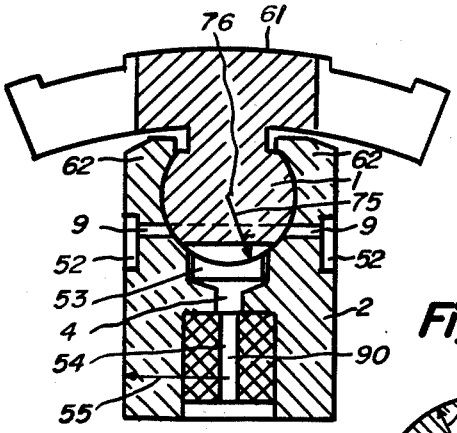
FIG. 5 is a cross-sectional view through FIG. 4 along the line V—V.
Figure 4:
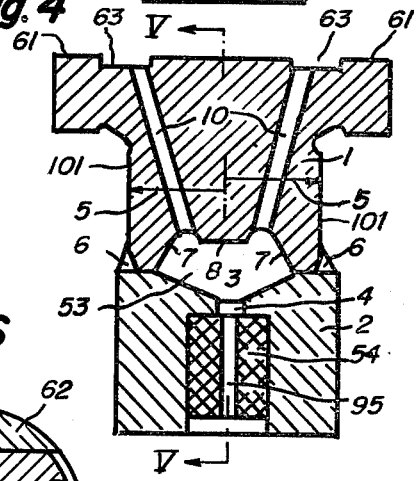
FIG. 4 is a sectional view through a piston-piston-shoe pivot assembly of the invention.
Figure 6:
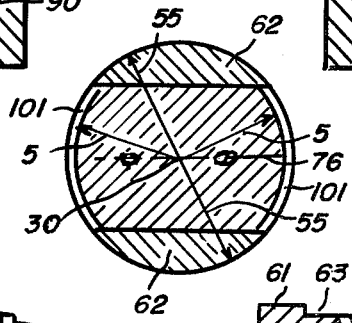
FIG. 6 is a sectional view through FIG. 4 along the line VI—VI.

In FIGS. 4 to 7 one embodiment of the invention is shown. FIG. 4 shows, that according to the invention the end of the pivot portion 1 is provided by an endface 101 which is partial cylindrically around the axis 30 and defined by radius 5. Radius 5 is a little bit shorter, than radius 55 of piston 2. Thereby the bearing face of the pivot portion is extended to a maximum of bearing area and still the pivot portions maintains its ability to move within the bed of the piston 2 and within the respective cylinder of the device. In order to prevent scratching of the cylinder's wall by the bottom corner of the end face 101 of the pivot portion during wide pivoted position, the bottom portion of the ends 30 are provided with a small inclination 6. The form of the ends 101 of the pivot portion 1 can be clearly seen in FIG. 6 and this figure shows also the relation of the pivot portion relative to the piston 2. Radius 5 is clearly demonstrated and the holders 62 of the pistons 2 are also shown, but they are no novelty of this invention. A further feature of the invention is the extension of the fluid pressure balancing recess 3 over a wide area of the pivot portion 1, so, that the remaining seal face portions are short enough but maintain the needed length in order not to wear dry but still to seal effectively. The best form is, to provide the end of the balancing recess 3 partially by a radius 8 around the same centre 30 of pivot member 1. The difference 5 minus 8 defines then the accurate seal face length. In order, that the sealing portions remain stiff enough to withstand deformation under high fluid pressure in recess 3, the inwardly directed inclined walls 7 are provided in the pivot portion 1. This inclination 7 of the invention serves however not only the purpose of strength but an additional purpose of the invention, namely to extend the length of the seal face portions as more, as farther as they are located away from the bottom of the bed in the piston 2. According to the invention, the bottom portion is so strongly pressed against the piston's bed, that the faces are so extremely close together, that the clearance there is almost zero. Consequentely in accordance with the invention the length of the seal face must here be very short. But, as seen in FIG. 5, the part-cylindrical configuration provides, that in the height of the axis 76 of the pivot bar 1 the faces are normal to the face direction of the bottom. Consequenetely in this area is no pressing force, which would press the seal faces together. Therefore, at these locations the clearance between pivot bar 1 and piston's bed appears. Leakage would escape through this clearance, if the seal faces would be short here. Therefore, the inclination 7 serves the purpose of extending the length of the seal faces as more as farther as the portion of the seal faces is remoter from the bottom of the bed in the piston 2. Thus, the inclination 7 provides an ideal condition for sealing and bearing of the pivot member 1 in the bed of the piston 2.

It is further seen from FIGS. 4 and 5, that a resepctive fluid pressure balancing recess 53 in piston 2 may be associated to the recess 3 in piston shoe bar 1. Thus, if the piston shoe 1 pivots extensively, it can be seen in FIG. 5, that then the recess 3 dislocates from the centre of the axis of the piston 2. A portion of the bearing bed or of the pivote portion 1 would then be insufficiently lubricated and balanced. Therefore at the respective portion, the lubrication and balancing action of fluid pressure is taken over partially by the recess 53 in the piston 2. At non-pivoted position the recess 53 has no purpose of action.

In FIG. 4 and 5 the control-corner 8 is provided. This corner has the purpose of controlling the flow of fluid under pressure into the passages 9 of FIG. 5 and therethrough into the piston's tangential balancing recesses 52. The balancing recesses 52 and the passages 9 in piston 2 are no novelty of the invention. In the former art however, the recesses 52 were located too wide inwards of the pistons. Therefore they were not very effective in operation. This was due to the too small balancing recess 53 of the former art. According to the invention the control corner 8 is so far distanced from the bottom of the piston's bearing bed, that the passages 9 can be provided more in the top portion of the piston 2. Thereby the passages 9 can be drilled normal to the axis of the piston and thereby become set more accurately, while the recesses 52 can be located more towards the top of the pistons 2 and thereby become more effective in operation of the device. The control corners 8 are closing the passages 9 in central position of non-pivoted location and they open either one of the passages 9, when the piston shoe pivots in the respective extent in the one or the other direction.

According to the invention it has also been discovered, that the former control corners prevented the needed lubrication of the upper portions of the seal faces of the piston's bed and pivot portion 1. Therefore, according to the invention the fluid pressure balancing port 3 of the invention is endwards of the control corners 8 extended more inwardly into the pivot portion 1, beyond the control corners 8. This provides the good lubrication of the seal faces area in the height of the axis 76. According to this invention, a flow through restriction by a narrow passage 90 may be provided in the piston 2 in order to prevent excessive flow of fluid into the pivot bar and its surrounding. It is preferred to drill a bigger bore from the bottom into the piston 2 and insert thereinto a filler 54. Such filler 54 may be of deformable material, for example of hard gum. The bore 90 can then be drilled easily and with a common drill. By making the diameter of filler 54 bigger, than the bore in the piston 2, the bore 90 will be restricted to the needed narrowness by deformation of filler 54, when it is pressed or inserted into the bore in the piston 2. This makes any narrowness desired possible without the need of expensive too small drills.

Figure 1:
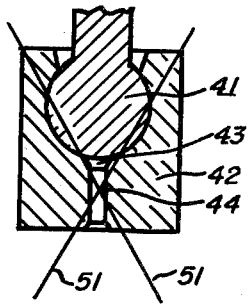
FIG. 1 is a sectional view through a pivot assembly of the former art.
Figure 9:
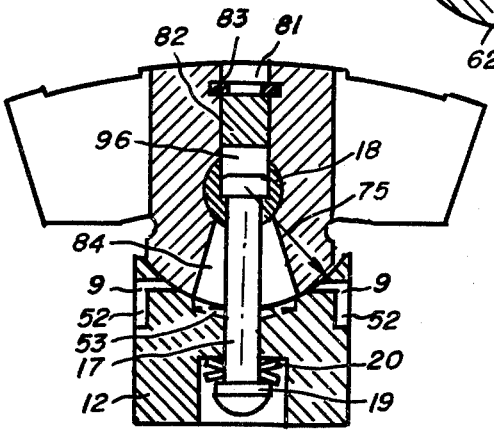
FIG. 9 is a cross-sectional view through FIG. 8 along the line IX—IX.
Figure 8:
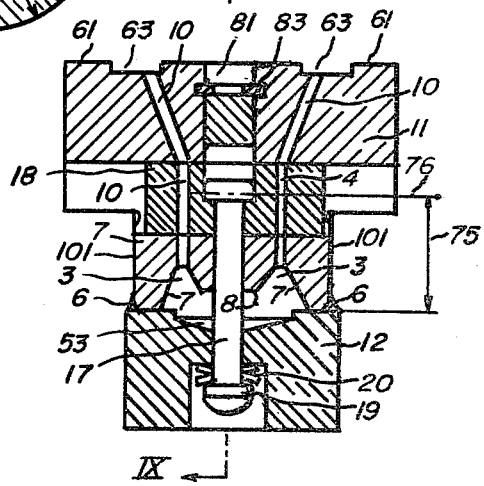
FIG. 8 is a sectional view through another embodiment of a piston-piston-shoe pivot assembly of the invention.

It has been found in accordance with this invention, that the drawbacks of the assembly of FIG. 1 resulted in cases of high pressures and speeds in a reduction of the efficiency of respective fluid handling devices by many percent and as high as until 15 percent. The assembly of FIGS. 2 and 3 reduced the efficiency of respective devices under such high pressure and speed until 6 percent. By the assembly of FIGS. 4 to 7 of the invention, the reduction of the efficiency of the respective device at same pressure-speed condition is reduced to less than 1.5 percent and in the assembly of FIGS. 8 and 9 of the invention it is reduced to less than 1 percent under same or equal pressure and relative move-speed conditions. The further increase in reduction of friction and/or leakage and thereby the further increase of the efficiency of the fluid handling device with the assembly of FIGS. 8 to 9 of the invention is thereby obtained, that the bearing face area is still further increased, the size of the balancing recess is still further increased and the stiffness of the tangent 51, if drawn, is reduced to an almost flattness. This is done thereby, that the radius 75 around the axis 76 of the pivot bar 1 is increased to be about 0.8 to 1.3 of the size of the radius 55 of the piston, 2. The piston embracement portion 62 of FIG. 5 is then no more existing. Equal referentials of FIGS. 8 and 9 with those of FIGS. 4 to 7 are citing similar means. In FIGS. 8 and 9 the said means are wider or more extended than in FIGS. 4 to 7. Because the radius 75 of FIGS. 4 to 7 is only 0.6 to 0.8 of the size of the piston-radius 55. In order to prevent escape of the pivot portion 1 away from the bed of piston 12 of FIGS. 8, 9 an assembly means, for example pin 17 is assembled through pivote portion 1 and piston 12. Holding means, like bar 18, head of pin 17 within pivote bar 1, spring means 20 and holders 19 may be associated to the assembly pin means 17. Respective spaces in piston 12 and pivote bar 1 or piston shoe 11 may be provided. As far as leakage might escape through bores, recesses or spaces, closure devices, for example 82 may be provided for example in space 81 and contained therein or be fastened therein by retainers, for example by retainer 83. Bar 18 may be parallel to the axis 76 or surrounding it and may closely fit in a respective bore in pivot bar 1. A recess 84 may be provided in pivot bar 1 or in piston 12 for enabling the pivoting motion of the pivot portion 1 by prevention of touch of pin 17 to neighbouring parts and for provision of the ability to pivot relatively between pin means 17, pivot bar 1 or piston 12.

Passages 10 are provided to pass fluid into balancing recesses 63 in the piston shoe's outer face. This provision is not a novel means of the invention. It is however novel and a means of this invention, to extend them from the balancing recesses 63 into the deeper portions of the balancing recess 3 beyond the control corners 8.

The pivot members 1 in pistons 2 with the improvements by this invention are mainly provided and associated to pistons and piston shoes in radial piston devices. It is however also possible to utilize them and to apply them in hydrostatic swing bearings or in hydrostatic pivot bearings. There they may serve different applications and not only fluid handling radical piston devices. The axis of the pistons, for example axis 95 of FIG. 4, will be called "a first axis"; the axis 76 for example of FIGS. 2,6,8 will be called "a second axis" and the axis 96 of FIG. 9 will be called "a third axis" and the point 30 of FIG. 6 will be called "an axis centre point" in the appended claims.

What I claim is as follows:

1. A hydrostatic pivot bearing consisting of a first body, a second body, bearing faces therebetween and a hydrostatic fluid pressure pocket in at least one of said bearing faces;

wherein said first body is of substantially cylindrical configuration around a first axis, wherein said first body has a bearing bed face of part-cylindrical configuration around a second axis, wherein said second axis extends normally to said first axis and through said first axis, wherein said second body has a part-cylindrical pivot-portion with a bearing face of part-cylindrical configuration around said second axis, wherein said bearing bed face and said bearing face of part-cylindrical configurations have substantially equal radii around said second axis; wherein said first axis and said second axis are meeting in an axes centre point;

wherein said bearing face of said second body is borne on said bearing bed face of said first body and able to slide therealong when said second body pivots on said first body while said faces are remaining at all times in close engagement along each other for sealing said fluid pressure pocket therebetween to prevent leakage thereout; wherein said second body has a third axis extending normal to and through said second axis and extending through said axes centre point whereby said third axis extends through said second and said first axis;

wherein said third axis swings through said first axis when said second body pivots relatively to said first body;

and wherein an improvement is provided which consists therein, that said part-cylindrical pivot-portion of said second body is provided with ends of part-cylindrical configuration of substantial radius around said third axis, whereby the length of the bearing area between said bearing faces is slightly shorter than the outer diameter of said first body for the provision of a maximum of bearing face area for the obtainment of the capability to carry a maximum of load by said bodies.

2. The bearing of claim 1 wherein a fluid pressure communication recess is provided through said first body to said fluid pressure pocket and wherein said fluid pressure pocket extends through said bearing face of said second body into said part-cylindrical pivot-portion with said ends of part-cylindrical configuration of said second body.

3. The bearing of claim 2, wherein said fluid pressure pocket is formed with end walls of part-cylindrical configuration around said third axis and wherein said endwalls of said fluid pressure pocket have smaller radii around said third axis than said radius of said ends has around said third axis whereby said bearing face of said second body is reduced to include bearing face portions of a length of the difference between said radius and one radius of said radii.

4. The bearing of claim 3, wherein said end walls of said fluid pressure pocket are inclined inwardly in said second body for forming rigid end portions on said part cylindrical portion of said second body.

5. The bearing of claim 4, wherein control corners are provided in the medial portion of said part-cylindrical pivot portion of said second body and wherein enlarged recesses extend between said control corners and said endportions beyond said control corners into said portion of said second body.

6. The bearing of claim 2 wherein said part-cylindrical pivot portion is defined by a radius around said second axis of a size of 0.8 to 1.3 of the radius of the outer face of said first body around said first axis of said first body.

7. The bearing of claim 1, wherein a retaining means is associated to said first and second bodies for retaining said bearing faces of said bodies closely together for sealing engagement of said bearing faces and wherein a space is provided for said retaining means to enable said retaining means to move in said space.

8. The bearing of claim 7 wherein a bore is provided in said pivot-portion of said second body around said second axis and parallel to said second axis, wherein a bore is provided through said first body around said first axis and parallel to said first axis, wherein a bore is provided in said second body around said third axis and parallel to said third axis, wherein a holding pin is provided with a reception bore therethrough, wherein said holding pin extends into said bore around said second axis whereby said reception bore locates around said third axis and wherein a fitting pin means extends through said first body bore and is connected to said first body via spring means and extends through said reception bore and is connected to said holding pin by a pin means head, said bores and pins defining said retaining means; whereby said first and second bodies are fastened together and said second body is able to pivot on said bearing bed face of said first body.

9. The bearing of claim 8 wherein closure means are provided in said bore around said third axis in order to close a portion of said bore around said third axis.

10. The bearing of claim 1, wherein said first body is a piston, wherein said second body is a piston shoe and wherein said pivot-portion of part-cylindrical portion is longer in the direction of said second axis than one half of the entire length of said piston shoe in the direction of said second axis.

* * * * *